US005597017A

United States Patent [19]

Eicher et al.

[11] Patent Number: 5,597,017

[45] Date of Patent: Jan. 28, 1997

[54] METHOD AND APPARATUS FOR PRODUCING A RETAINING NET

[75] Inventors: Bernhard Eicher, Roggwil; Xaver Popp, Loemmenschwil, both of Switzerland

[73] Assignee: Fatzer AG, Romanshorn, Switzerland

[21] Appl. No.: 416,612

[22] Filed: Apr. 5, 1995

[30] Foreign Application Priority Data

Apr. 8, 1994 [CH] Switzerland ..... 01048/94

[51] Int. Cl.[6] ..... B21F 31/00

[52] U.S. Cl. ..... 140/3 B

[58] Field of Search ..... 140/3 R, 3 B, 140/3 BA, 9, 11, 12

[56] References Cited

U.S. PATENT DOCUMENTS 442,436 12/1890 Hinds ..... 140/3 B
960,485 6/1910 Bement ..... 140/3 B
2,349,750 5/1944 Peterson et al. ..... 140/3 R
3,539,135 11/1970 Berg .

FOREIGN PATENT DOCUMENTS 0370945 5/1990 European Pat. Off. .

*Primary Examiner*—Lowell A. Larson
*Attorney, Agent, or Firm*—W. G. Fasse; W. F. Fasse

[57] ABSTRACT

A retaining net is made of wire rings which are interlooped when producing at least some of the rings while other rings that participate in the interlooping are prefabricated. Such nets are used for protection against falling rocks, avalanches, and mud slides. The interlooping rings are formed by feeding a wire (22) through a bending tool (15) to form several turns that interloop with at least two prefabricated rings (20A, 20B) that are held by suspender members (31) so that the rings (20 being formed extend crosswise to the prefabricated rings. When the formation of a first row of interlooped rings is completed, that row is interlooped with a second row and so forth. The interlooped ring structure provides a simple, cost effective construction method for strong retaining nets.

7 Claims, 2 Drawing Sheets

METHOD AND APPARATUS FOR PRODUCING A RETAINING NET

FIELD OF THE INVENTION

The invention relates to a method and apparatus for producing retaining nets which are used for protection against falling rocks and avalanches as well as mud slides. Such nets are also suitable for other heavy duty retaining purposes and for preventing soil erosion.

BACKGROUND INFORMATION

Conventionally, retaining nets for the above outlined purposes have been produced of individual multi-strand steel cables interconnected by rings through which the cables loop. The ends of a cable forming a loop are interconnected by a compression bushing also known as crimping bushing. This type of construction of retaining nets has been found to be satisfactory. However, the conventional method is relatively expensive and involved, so that it leaves room for improvement.

Further, retaining nets produced of rings once installed, must be capable of taking up substantial forces, for example for retaining an avalanche or falling rocks. Another requirement to be met by such nets is a very high corrosion resistance, because these nets must remain in position over long periods of time even decades when these nets are installed on mountain sides along roads and the like. Especially, nets that are installed in direct contact with steep hillsides for preventing soil erosions must be capable to hold up large surface area mud slides as well as corrosion attacks.

OBJECTS OF THE INVENTION

In view of the above it is the aim of the invention to achieve the following objects singly or in combination:

- to provide a method and an apparatus for the efficient and hence economical production of retaining nets;
- to avoid the use of cable loops in the interconnection of a multitude of rings;
- to construct such retaining nets in such a way that they are capable of taking up and dissipating kinetic or rather dynamic loads by an initial elastic deformation of the retaining net; and
- to construct a retaining net in such a way that it is capable of stretching in response to taking up a load, such as a falling rock.

SUMMARY OF THE INVENTION

According to the invention prefabricated rings are interlooped by wire rings that are being formed while simultaneously performing the interlooping. The interlooping wire rings are formed by feeding an individual wire into a bending mold or tool for forming several wire turns which pass through the ring opening of at least two neighboring prefabricated rings.

The present method is performed by an apparatus according to the invention in which the bending mold or tool is constructed for shaping a running-in wire into an arcuate configuration to form, as the feeding of the wire continues, a ring having several turns. The apparatus further includes suspender members for holding prefabricated rings in such position that the main plane of the prefabricated rings extends crosswise to the plane of the ring that is being formed by the looping of the wire in the bending tool, which is arranged laterally of the suspended rings in such a way that the circular turns of the ring being formed in the bending tool pass or loop through the central openings of two neighboring suspended rings.

It is an advantage of the invention that it does not use cable sections having twisted multi-strands. Rather, these cable sections have been replaced according to the invention by rings that are formed from a single wire that is being bent to form several loose turns which are subsequently held together in a radial direction by clamps or the like. Such retaining nets are suitable for taking up high loads. This capability is enhanced by the fact that a kinetic or dynamic load imposed on such retaining nets, for example by falling rocks, results initially in the deforming of the originally circular wire ring into an approximately square configuration. As a result of this deformation the net is capable of stretching which in turn enables the net to gradually dissipate the dynamic forces initially effective on the net and then to hold a dynamic load.

By using a single wire rather than a pre-twisted multi-strand cable, the present apparatus provides an advantageous yet simple ring formation, whereby a wire is formed into a circular shape by a bending tool that can be adjusted for forming wire rings of the desired diameters. A plurality of turns may be formed and these turns rest flat against each other, since each turn has the same diameter. The formation of the ring by winding several turns automatically results in the interlinking of prefabricated rings because the loops that form the turns pass through the prefabricated rings. Another advantage is seen in that the single wire may be a relatively thick wire compared to the thin individual strands of a twisted cable. A thick wire is more corrosion resistant than a thin wire, other conditions being equal.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
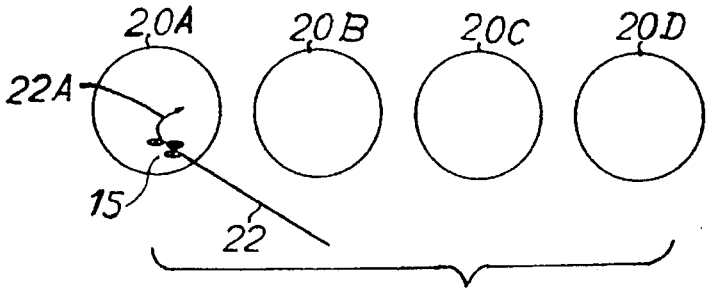
FIG. 1 shows a group of four prefabricated wire rings and the beginning of an arc for forming a first looping ring passing through the first prefabricated ring of the group four prefabricated rings forming three pairs of rings to be looped.
Figure 2:
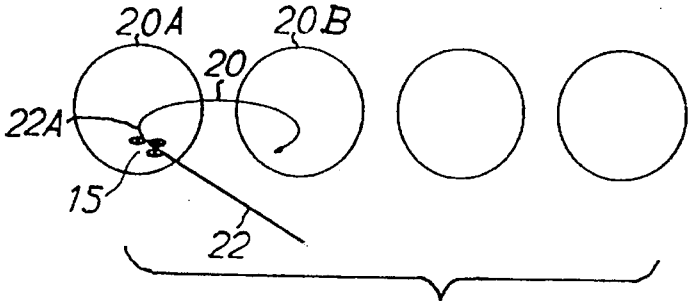
FIG. 2 is a view similar to that of FIG. 1 illustrating the progress of the loop formation.
Figure 3:
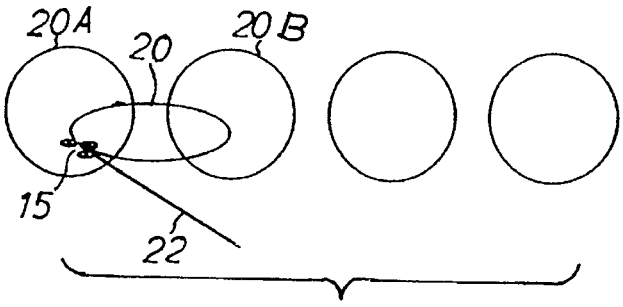
FIG. 3 illustrates the completion of the first looping ring interconnecting the first two rings of the group of prefabricated rings.
Figure 4:
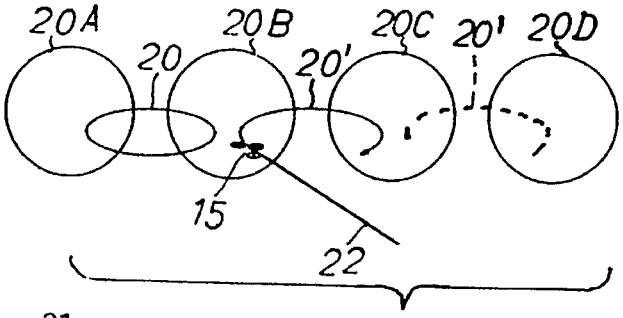
FIG. 4 illustrates the interconnection of the first two prefabricated rings by the completed first looping ring and the partly completed second looping ring interconnecting the second and third rings of the group of prefabricated rings.

Referring to FIGS. 1 to 4, the present method will first be described. First, a plurality of separate rings 20A, 20B, 20C and 20D and so forth are prefabricated of steel wire by any conventional ring forming method. These rings 20A, 20B, 20C, 20D will be held by a suspender member 31 shown in FIG. 5. A bending tool 15 shown in FIG. 1 is shown in more detail in FIG. 5. The bending tool 15 shapes an incoming individual wire 22 into an arcuate configuration 22A which passes through the first ring 20A of the group of rings. As shown in FIG. 2, the arcuate configuration 22A of the wire 22 passes through the opening of the ring 20A and as the shaping continues, through the opening of the next neighboring ring 20B. FIG. 3 shows that the arcuate bend of the wire 22 has formed a complete ring 20. The ring 20 preferably comprises a plurality of turns, each of which has substantially the same diameter. As shown in FIG. 4, the bending tool 15 is now displaced into a position to cooperate with the next prefabricated ring 20B for the insertion of the next looping ring through the prefabricated ring 20B and the prefabricated ring 20C. The ring formation for the next ring 20' is a mere repetition of the formation of the ring 20. The number of repetitions depends on the number of interlooping rings and on the intended width of the finished retaining net. Once one row of rings has been interlooped, the interlooped row of rings will then be looped to the next row in the same manner as has been described above until the desired length of the retaining net has been achieved. As shown, four prefabricated rings 20A, 20B, 20C, and 20D require three interlooping rings so that three interlooped pairs are formed, namely 20A plus 20B, 20B plus 20C, and 20C plus 20D.

Figure 5:
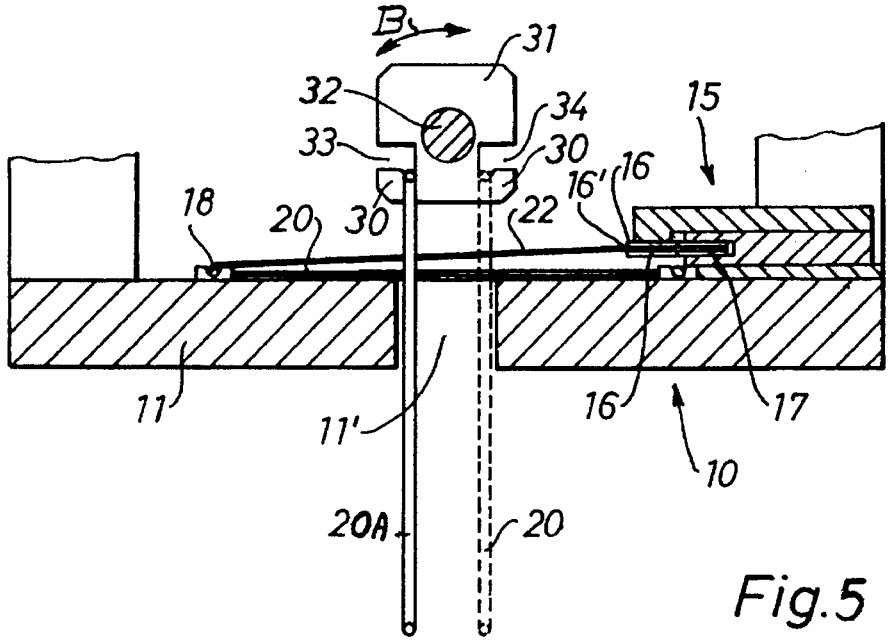
FIG. 5 is a sectional schematic view through an apparatus according to the invention for forming the interlooped retaining nets.
Figure 6:
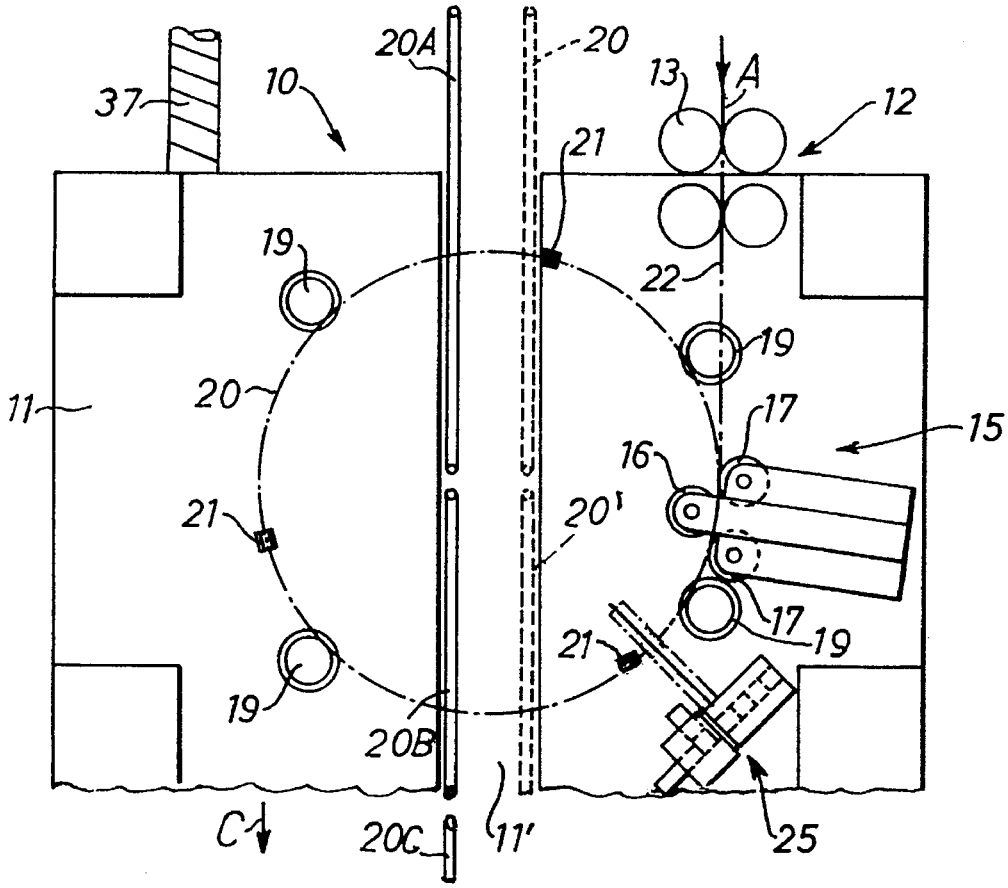
FIG. 6 is a top plan view onto the apparatus of FIG. 5, however omitting a suspender device for holding prefabricated rings.

FIGS. 5 and 6 illustrate an apparatus 10 for the production of the interlooping rings 20, 20'. The apparatus 10 comprises a support 11 for a wire feeder 12, a bending tool 15 arranged downstream of the wire feeder 12 as viewed in the wire feed advance direction and a wire cutter 25 as well as wire guides 18 and 19, for example in the form of rollers mounted on the support 11, which is provided with an approximately centrally located longitudinal opening 11' to permit prefabricated wire rings 20A, 20B, 20C and if desired 20 and 20' to be suspended to assume a substantially vertical disposition as best seen in FIG. 5. The rings 20 and 20' are looping rings previously formed.

The wire feeder 12 is motor driven and comprises several, preferably four feeder rollers 13 for passing the wire 22 in the direction of the arrow A toward the bending tool 15. The rollers 13 form a feeder gap through which the wire 22 is passed. At least one of the rollers 13 is driven by an RPM variable motor not shown for selecting the desired feed advance speed for the wire 22. As the wire enters into a gap between bending rollers 16 and 17 of the bending tool 15, the formation of the arcuate configuration shown in FIG. 1 begins. At least the roller 16 is radially variable in its position to change the diameter of the ring being formed. The wire 22 is first bent into the arcuate configuration at the forward end of the wire 22. As the feed advance continues, a wire ring guided by the rollers 18 and 19 is completed. The roller 18 shown in FIG. 5 supports the wire turns substantially opposite the bending tool 15 and from below. The rollers 19 retain the wire turns radially.

The rollers 16 and 17 of the bending tool 15 are positioned on opposite sides of the wire 22. Upon completion of a full wire turn the wire feed advance is continued until the desired number of turns has been formed, whereby all turns have practically the same diameter. As soon as the desired number of turns has been formed, the wire is cut by the wire cutter 25 directly following a complete turn formation that is downstream of the bending tool 15.

The so-formed turns are interconnected at their circumference by radially effective holding clamps 21, such as C-clamps which are crimped tight by a crimping tool to fully encircle the wire turns to form the rings 20, 20' etc. The initially laterally open clamp is completely closed after the crimping deformation to form an O-clamp. As a result, the ring 20, 20' is closed and the desired number of turns are held together without being twisted, whereby the resulting ring comprises several turns of one uninterrupted wound wire 22. Preferably, a crimping tool for forming crimped clamps 21 that hold the wire turns together, can be part of the wire cutter 25.

Figure 7:
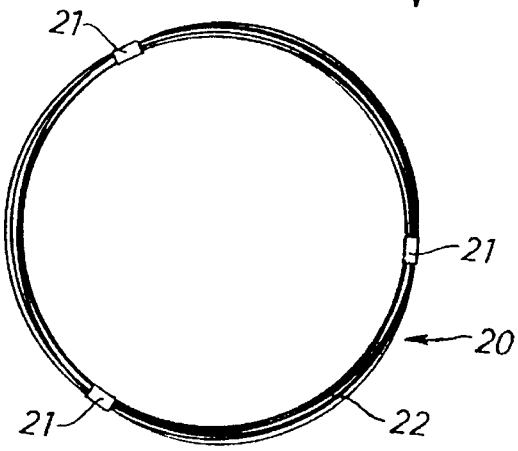
FIG. 7 is a plan view of an interlooping ring formed on the apparatus of FIGS. 5 and 6, and having several wire turns held together by crimped clamps.

The wire 22 is preferably a heat galvanized steel wire stock having a circular cross-section or the wire is made of stainless steel to have the required corrosion resistance. The ring 20 comprises preferably 3 to 15 turns and the wire thickness is advantageously within the range of 1 to 5mm. For example, FIG. 7 shows a ring 20 comprising seven turns with a ring diameter within the range of 250 to 300mm and a wire diameter of 3mm. The ring is made of heat galvanized steel wire, in this instance.

As explained above with reference to FIGS. 1 to 4, several prefabricated rings 20A, 20B are suspended in a row so that the Wire 22 may be looped through the rings 20A, 20B while forming the ring 20. The prefabricated rings 20A, 20B and 20C etc. are preferably made of the same materials as the looping ring 20, 20'.

Referring to FIG. 5, the interlooping is facilitated by suspending the prefabricated rings 20A, 20B from a suspender member 31. A plurality of such suspender members 31 are preferably arranged in a row and rigidly mounted to a rotatable shaft 32, which in turn is mounted above the support 11 in parallel to the longitudinal opening 11' through the support 11. Each of these suspender members 31 has two laterally open slots 33 and 34 facing in opposite directions and forming hooks 30 for suspending prefabricated rings 20A, 20B. These hooks 30 hold the prefabricated rings 20A, 20B in a row as best seen in FIG. 6. If desired, two rows of rings may be suspended in parallel to each other as best seen in FIG. 6. The second row of rings 20, 20' are shown in dashed lines. The second row 20, 20' are looping rings or also prefabricated rings.

The shaft 32 is rotatable clockwise our counterclockwise as indicated by the arrow B sufficiently for releasing the rings 20A, . . . from the hooks 30 . . . after the interlooping of a row of rings is completed.

As seen in FIGS. 5 and 6, the arrangement is such, that the rings suspended from the suspender members 31 extend perpendicularly to the surface of the support 11 and thus substantially perpendicularly to the rings 20 being formed on the table top 2. Thus, when the support 11 extends horizontally, the rings 20A, 20B, 20C assume a vertical orientation, whereby the main plane of the rings 20A, 20B, 20C extends perpendicularly to the main plane of the rings 20, 20' being formed on the table top 11. As best seen in FIG. 6, the loops formed by the tool 15 in cooperation with the guide rollers 19 pass through the central openings of the suspended rings 20A, 20B. Once the desired number of turns in the ring 20 on the support 11 has been formed and after the clamps 21 have been crimped onto the wire turns, the ring 20 is lifted off the support 11 either manually or by a lifting mechanism not shown. In order to form the next interlooping ring, the support 11 including the bending tool 15 is displaced in the direction of the arrow C, for example by a spindle drive 37 extending in parallel to the rotatable shaft 32, until the next two rings 20B and 20C are in a position for the next interlooping procedure. The previously produced interlooping ring 20 is then lifted manually or by a respective lifter into the slots 34 of the suspender member 31, so that these rings will be out of the way when the next two prefabricated rings 20B and 20C are being interlooped in the displaced position of the tool 15 on the support 11. The above described operations are then repeated, whereby the next looping ring 20' is formed to interloop the rings 20B and 20C. The described operations are repeated until the width of the net to be produced has been reached by a respective number of interlooped rings. After a row with the desired number of rings has been formed, the shaft 32 is turned counterclockwise by about 90°. The suspender member 31 turns with the shaft 32, since these members are rigidly secured to the shaft 32, whereby the rings 20A, 20B, 20C held in the slot 33, are dropped. The interlooping rings 20 and 20' hold the prefabricated rings 20A, 20B and 20C together.

The shaft 32 is then rotated back into the original position and support 11 is also displaced back into the original position by rotating the spindle drive 37 in the opposite direction. Then the bending tool 15 produces new ring turns passing through the rings suspended in the slot 34. These rings are lifted either by hand or by a lifter not shown into the vertical position by rotating these rings through 90° and suspending these rings from the now empty slot 33. In order that the rings 20, 20' may extend into the opening 11' in the suppory 11 to assume a substantially vertical position, the shaft 32 with the suspender members 31 is either lifted or the support 11 is lowered. Alternatively, the support 11 may be laterally displaced in order to align these rings vertically. The above described looping steps are then repeated until a second row of interlooped rings has been formed. When in this manner a second row of rings has been produced, the shaft 32 is rotated counterclockwise, whereby the rings in the slot 34 are released. In this manner three interlooped rows of rings arranged one above the other are formed. In this manner it is now possible to form a net of any desired length. The interlooping illustrated in FIGS. 1 to 4 applies equally to the interlooping of the rings 20A of FIG. 1 with ring 20A of FIG. 2 and 20A of FIG. 2 with 20A of FIG. 3 etc. to form the net.

The above mentioned variation in which prefabricated rings are held in both slots 33 and 34 permits the formation of two rows of rings simultaneously, because the interlooping passes through four rings at a time.

A further modification provides for arranging several bending tools in parallel to each other for providing partial nets which are then interlooped with each other. In this manner any size nets may be efficiently formed.

Although the invention has been described with reference to specific example embodiments, it will be appreciated that it is intended to cover all modifications and equivalents within the scope of the appended claims.

What is claimed is:

1. A method for producing a retaining net made of wire rings, comprising the following steps:

(a) prefabricating first closed wire rings (20A, 20B, 20C, . . . ) each having a plurality of windings held together by clamps (21), (b) suspending said first closed wire rings in a row to freely hang down in a substantially vertical plane, (c) feeding a single strand wire (22) through a bending tool (15) to form an initial arcuate configuration (22A), (d) interlooping said initial arcuate configuration in a substantially horizontal plane through at least two first closed wire rings (20A, 20B) extending in said substantially vertical plane and continuing to bend and feed said single strand wire (22) to form a looping second closed wire ring (20, 20') having a plurality of turns that interloop said two first closed wire rings (20A, 20B), (e) securing a number of clamps (21) to said plurality of turns of said looping second closed wire ring (20, 20') for holding said turns together, (f) displacing said bending tool (12, 11) in a substantially horizontal plane when said interlooping step is completed, and (g) repeating said interlooping, securing, and displacing steps until a number of first closed wire rings (20A, 20B, 20C, . . . ) are interlooped with a required number of second closed wire rings (20, 20', . . . ) to form said retaining net.

2. The method of claim 1, comprising tightening said clamps (21) by crimping.

3. An apparatus for producing a retaining net made of wire rings, comprising a rotatable suspender drive shaft (32), a plurality of suspender hooks (30) rigidly secured to said drive shaft (32) and forming at least one row of hooks along said drive shaft (32) for tilting said hooks through an angular range sufficient for simultaneously releasing all first wire rings (20A, 20B, 20C) from said at least one row of hooks when tilting in one direction, said hooks suspending said first wire rings in a first substantially vertical plane when said hooks are not tilted, a wire bending mechanism (11, 15) for bending a wire (22) into an arcuate shape and into looping second wire rings (20, 20') comprising a number of turns for extending in a second substantially horizontal plane for interlooping said turns of said looping second wire rings (20, 20') formed by said wire bending mechanism (11, 15) in a substantially horizontal plane through two neighboring suspended first wire rings (20A and 20B or 20B and 20C), wherein said wire bending mechanism comprises a bending tool (15) arranged laterally of said first substantially vertical plane of said suspendable first closed wire rings (20A, 20B, 20C), wherein said suspender drive shaft (32) with said at least one row of hooks (30) is arranged laterally above said wire bending mechanism (11, 15), wherein said bending tool comprises a wire feeder (12, 13) for feeding wire (22) through said bending tool (15) for forming said arcuate shape into a loop extending through central openings of said first suspendable wire rings (20A, 20B, 20C), said apparatus further comprising drive means (37) for displacing said apparatus with said bending mechanism in a direction parallel to a longitudinal axis of said rotatable drive shaft (32), wherein said suspender hooks (30) are formed for normally holding said first rings (20A, 20B, 20C) in said substantially vertical plane, and wherein said drive shaft (32) is rotatable for releasing rings from said hooks, said apparatus further comprising a wire cutter and clamping tool (25) including crimping means for fixing holding clamps (21) around said turns of said rings (20, 20') arranged downstream of said wire bending tool (15) as viewed in a wire feed advance direction of said wire (22).

4. The apparatus of claim 3, further comprising a mounting support (11) forming an opening (11') in said support (11), said opening extending approximately along a diameter of a second wire ring (20, 20') formed by said bending tool (15), said opening (11') extending substantially in parallel to said drive shaft (32) for permitting suspended first wire rings to extend substantially vertically downwardly into said opening (11').

5. The apparatus of claim 4, further comprising guide rollers (19) positioned on said mounting support (11) relative to said bending tool (15) for leading wire (22) past said bending tool (15) and for guiding said second rings (20, 20', . . . ).

6. The apparatus of claim 3, wherein said at least one row of hooks forms a first row of hooks, said apparatus further comprising a second row of hooks arranged in parallel to said first row of hooks, so that the hooks of said first row face in one direction while the hooks of said second row face in a direction opposite to said one direction.

7. The apparatus of claim 3, further comprising suspender members (31) secured to said drive shaft (32), said suspender members (31) having slots therein to form said suspender hooks.

* * * * *